United States Patent [19]

Watanabe et al.

[11] Patent Number: 4,970,787

[45] Date of Patent: Nov. 20, 1990

[54] ADJUSTABLE TUBULAR HAIR CUTTING APPARATUS

[76] Inventors: Joji Watanabe; Shigeko Watanabe, both of 2-21 Tachibana-cho, Kuwana-shi, Mie-pre, Japan, 511

[21] Appl. No.: 493,636

[22] Filed: Mar. 15, 1990

[51] Int. Cl.[5] ..... B26B 15/00; B26B 19/00; B25F 1/04

[52] U.S. Cl. ..... 30/132; 30/133; 30/41.5

[58] Field of Search ..... 30/41.5, 41.6, 125, 30/132, 133, 134, 200; 132/65.1, 71.1, 66.1, 212, 213

[56] References Cited

U.S. PATENT DOCUMENTS 2,134,960 11/1938 Testi ..... 30/41.5
4,188,720 2/1980 Korf ..... 30/133
4,407,068 10/1983 Wilson ..... 30/133

FOREIGN PATENT DOCUMENTS 3118643 11/1982 Fed. Rep. of Germany ..... 30/133
3800966 7/1989 Fed. Rep. of Germany ..... 30/133
2400414 3/1979 France ..... 30/133

*Primary Examiner*—Douglas D. Watts
*Assistant Examiner*—Paul M. Heyrana, Sr.
*Attorney, Agent, or Firm*—Leon Gilden

[57] ABSTRACT

An apparatus including a cylindrical housing mounting an upper cylindrical housing slidably thereto to vary a spacing between an entrance of the upper cylindrical housing to a series of cutting blades. The cutting blades are mounted to a rotating shaft of an electric motor, with an exhaust conduit positioned between the electric motor and the cutting blades for directing cut hair and debris exteriorly of the housing, with the conduit associated with a source of vacuum, and wherein the conduit includes sliding doors for varying the degree of vacuum directed to the conduit. Alternative configurations include a self-enclosed housing with the vacuum source defined by impeller blades mounted within a lowermost portion of the housing underlying a porous bag with the housing separable to gain access to the porous bag utilizing either a direct drive for the impeller blades, or alternatively a gear drive to circumvent the porous bag.

7 Claims, 4 Drawing Sheets

PRIOR ART

ADJUSTABLE TUBULAR HAIR CUTTING APPARATUS

BACKGROUND OF THE INVENTION

1. Field of the Invention

The field of invention relates to hair cutting apparatus, and more particularly pertains to a new and improved hair cutting apparatus wherein the same accommodates long lengths of hair to effect a trimming operation thereof.

2. Description of the Prior Art

Hair cutting and trimming organizations associated with a vacuum source have been developed in the prior art to simultaneously trim and vacuum cut hair. Examples of the prior art include U.S. Pat. No. 4,670,982 to Kim wherein a housing includes a cutter blade mounted therewithin, wherein an orthogonally mounted conduit relative to an upper portion of the housing is securable to a vacuum source, but the Kim patent, as is typical of such prior art devices, fails to provide a vacuum varying organization to vary the degree of vacuum imparted by the vacuum source, and it fails to provide a self-contained organization as is also typified by the instant invention.

U.S. Pat. No. 4,679,322 to Hunts utilizes a hair clipper arrangement wherein a flow chamber is mounted in alignment with a cutter, wherein the cutter is positioned adjacent an open end of the housing. The Hunts patent, as is typical of the prior art, fails to provide an adjustment sleeve and outer portion of the housing to vary spacing from an entrance of the housing to the cutter blades.

U.S. Pat. No. 4,314,405 to Park sets forth a hair cutting device with a hair cutter and drive motor being reversible, with a heating element attached to the outlet to convert the device to a blower-drier.

U.S. Pat. No. 4,704,794 to Paradis provides a hair clipper with a hand manipulatable case to overlie hair for cutting thereof, with a conduit directed exteriorly of the case securable to a vacuum source for removal of cut hair.

U.S. Pat. No. 4,590,675 to Louw provides a hair cutting tube for securement to a vacuum source to direct cut hair to the vacuum source.

As such, it may be appreciated that there continues to be a need for a new and improved hair cutting apparatus as set forth by the instant invention wherein the same addresses both the problems of ease of use of the organization by individuals to enable an expedient and efficient cutting of hair with minimal training required by such individual, and further accomplishes this utilizing compact structural inter-relationship of an aligned cylindrical housing readily manipulated by the individual.

SUMMARY OF THE INVENTION

In view of the foregoing disadvantages inherent in the known types of hair cutting apparatus now present in the prior art, the present invention provides a hair cutting apparatus wherein the same permits an aligned cylindrical housing to be easily manipulated and deployed about a subject whose hair is to be cut and/or trimmed. As such, the general purpose of the present invention, which will be described subsequently in greater detail, is to provide a new and improved hair cutting apparatus which has all the advantages of the prior art hair cutting apparatus and none of the disadvantages.

To attain this, the present invention provides an apparatus including a cylindrical housing mounting an upper cylindrical housing slidably thereto to vary a spacing between an entrance of the upper cylindrical housing to a series of cutting blades. The cutting blades are mounted to a rotating shaft of an electric motor, with an exhaust conduit positioned between the electric motor and the cutting blades for directing cut hair and debris exteriorly of the housing, with the conduit associated with a source of vacuum, and wherein the conduit includes sliding doors for varying the degree of vacuum directed to the conduit. Alternative configurations include a self-enclosed housing with the vacuum source defined by impeller blades mounted within a lowermost portion of the housing underlying a porous bag with the housing separable to gain access to the porous bag utilizing either a direct drive for the impeller blades, or alternatively a gear drive to circumvent the porous bag.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hair cutting apparatus which has all the advantages of the prior art hair cutting apparatus and none of the disadvantages.

It is another object of the present invention to provide a new and improved hair cutting apparatus which may be easily and efficiently manufactured and marketed.

It is a further object of the present invention to provide a new and improved hair cutting apparatus which is of a durable and reliable construction.

An even further object of the present invention is to provide a new and improved hair cutting apparatus which is susceptible of a low cost of manufacture with regard to both materials and labor, and which accordingly is then susceptible of low prices of sale to the consuming public, thereby making such hair cutting apparatus economically available to the buying public.

Still yet another object of the present invention is to provide a new and improved hair cutting apparatus which provides in the apparatuses and methods of the prior art some of the advantages thereof, while simultaneously overcoming some of the disadvantages normally associated therewith.

Still another object of the present invention is to provide a new and improved hair cutting apparatus wherein the same provides for an easily positioned hair cutting instrument to be directed overlying an individual's hair to be cut, and further directs cut hair to a convenient collection source utilizing a vacuum.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
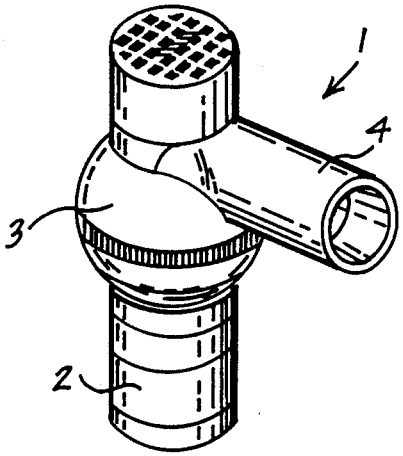
FIG. 1 is an isometric illustration of a prior art hair cutting apparatus.

With reference now to the drawings, and in particular to FIGS. 1 to 9 thereof, a new and improved hair cutting apparatus embodying the principles and concepts of the present invention and generally designated by the reference numerals 10 and 10*a* will be described.

Figure 2:
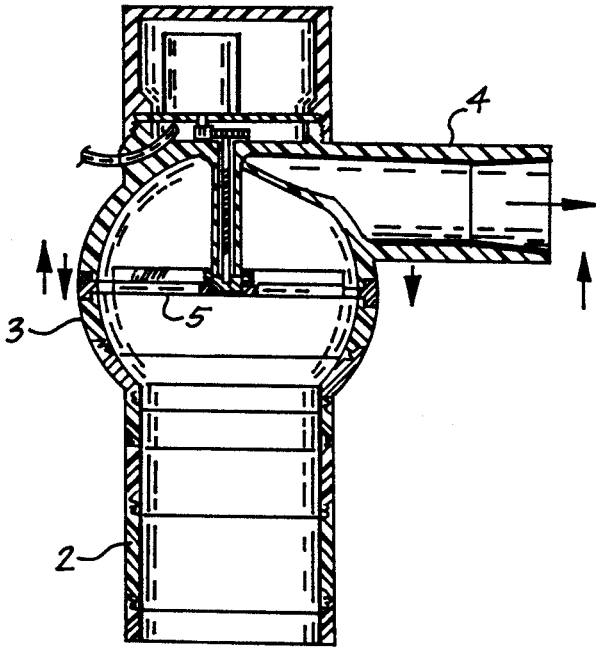
PRIOR ART FIG 2
FIG. 2 is an orthographic cross-sectional view of the hair cutting apparatus of FIG. 1.

FIGS. 1 and 2 are illustrative of a prior art hair cutting apparatus 1 utilizing a lower cylindrical housing 2 directed upwardly into a spherical housing 3 containing a hair cutter 5 therewithin, wherein cut hair is directed through an output conduit 4 secured to a conventional vacuum cleaner and the like.

More specifically, the hair cutting apparatus 10 of the instant invention essentially comprises a main cylindrical housing 11 with an upper adjustable cylindrical housing sleeve 11*a* adjustably mounted relative to the main cylindrical housing to adjust an entrance opening of the upper sleeve 11*a* relative to a rotating cutting blade organization 15. An electric motor 12 is mounted within and coaxially aligned within the cylindrical housing, including a motor output shaft 14 rotatably mounting the shaft relative to the motor to rotate the associated blades 15. A rigid conduit 13 is orthogonally mounted through a side wall of the main cylindrical housing 11 between the blades 15 and the motor 12. An annular shield 23 of a diameter substantially equal to that of the internal diameter defined by the cylindrical housing 11 protects the motor 12 from debris and further forces the flow of air and debris into the conduit 13 during use of the apparatus. A first flexible connector hose 16 is mounted to the rigid conduit 13 at an upper end of the flexible hose and mounted orthogonally to an adjustment conduit 17 at a lowermost end of the flexible hose. The adjustment conduit 17 includes a first sliding door 18 mounted through an end of the conduit, with a second sliding door 19 mounted through an elongate wall of the conduit, wherein the first sliding door 18 overlies an annular opening 20 to provide a first adjustment for adjusting the degree of vacuum directed through the adjustment conduit, with the second sliding door 19 overlying an elongate rectangular opening 21, wherein the first and second sliding doors provide varying degrees of adjustment of vacuum, as a second flexible connector hose 22 mounted to the adjustment conduit 17 is typically secured to a vacuum source, such as a vacuum cleaner connection pipe.

Figure 3:
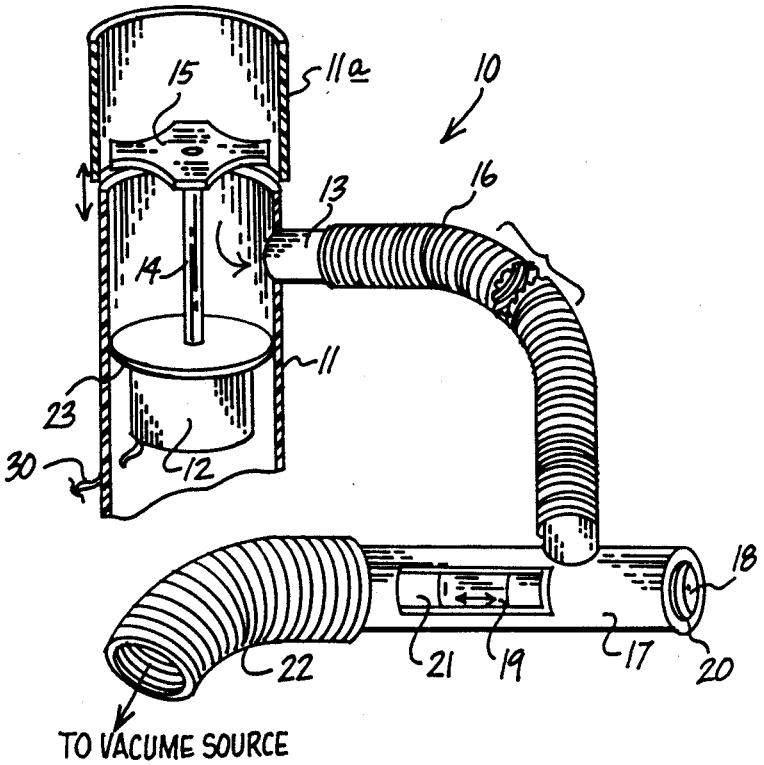
FIG. 3 is an isometric illustration, partially in section, of the instant invention.
Figure 5:
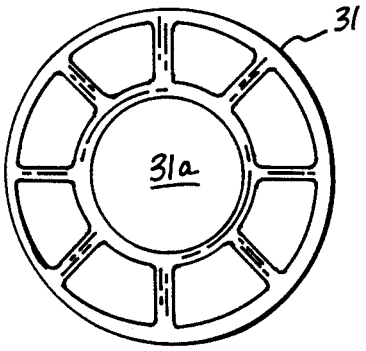
FIG. 5 is a top orthographic view of the upper first guard utilized by the instant invention, as illustrated in FIG. 4.
Figure 4:
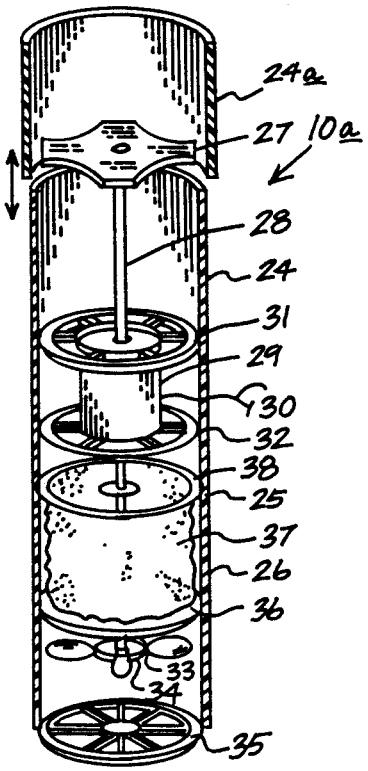
FIG. 4 is an isometric cross-sectional illustration of a modified hair cutter apparatus utilized by the instant invention.

Reference to FIG. 4 illustrates the modified hair cutting apparatus 10*a* including a main cylindrical housing 24 with an upper adjustable cylindrical sleeve 24*a* slidably mounted relative thereto, wherein as in the embodiment of FIG. 3, the entrance opening to the sleeve is adjustable to permit adjustment of a length of hair to be cut, as the entrance opening of the sleeve 24*a* spaced above the cutter blades 27 adjusts a length of hair being cut as the sleeve 24*a* upper end is traversed about a surface of an individual's head to be cut. A threaded connection 25 threadedly separates the main cylindrical housing 24 from a lower housing 26 to gain access to components aligned with the threaded connection 25, such as the porous collection bag 37 mounted between an upper support rim 38 and a lower support rim 36. The rims provide support for the porous collection bag 37 but are open throughout their central open to permit the vacuum to be effected by the impeller blades 34 mounted to a lowermost end of a lower shaft 33 that is mounted coaxially aligned with a main housing 25 and the electric motor 29. The electric motor 29 includes an upper shaft 28 mounting the cutter blades 27 thereon. A power line 30 provides power to the electric motor 29 in a similar manner as power supplied to the motor 12 of the embodiment of FIG. 3. An upper apertured guard 31 overlies an upper end of the electric motor 29 as it is coaxially aligned within the main housing 24, with a middle guard 32 underlying the electric motor to position and secure the motor therebetween. The upper and middle guards include a central aperture 31*a* (see FIG. 5) to secure the motor 29 therebetween. A lower guard 35 is positioned within the lowermost terminal end of the lower housing 26 to prevent inadvertent positioning of objects within the lower housing 26.

Figure 4A:
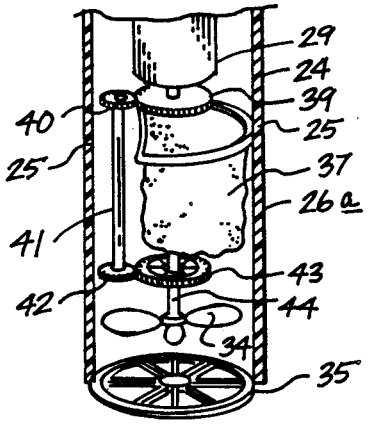
FIG. 4*a* is an isometric cross-sectional illustration of the modified hair cutter apparatus of FIG. 4 utilizing a gear drive for the fan in the lower housing.
Figure 6:
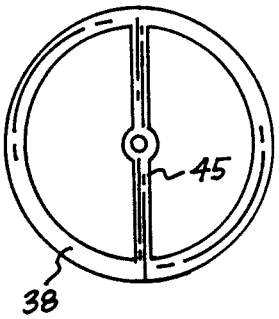
FIG. 6 is a top orthographic view of the upper support rim of the collection bag utilized by the instant invention.
Figure 7:
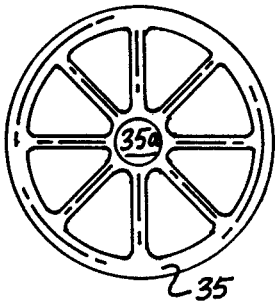
FIG. 7 is a top orthographic view of the lower guard utilized by the instant invention, as illustrated in FIG. 4.
Figure 8:
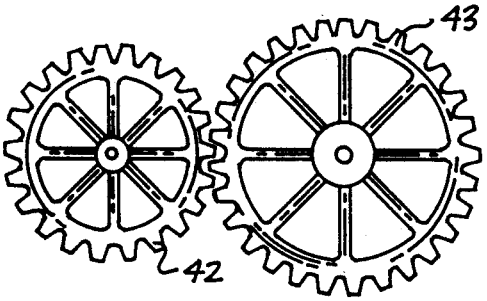
FIG. 8 is a top orthographic view of the apertured lower drive gears utilized by the instant invention, as illustrated in FIG. 4*a*.
Figure 9:
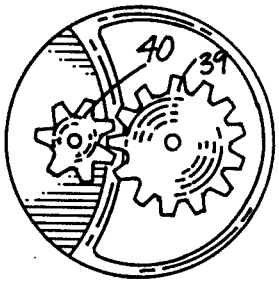
FIG. 9 is a top orthographic view of the solid drive gears as utilized by the instant invention, as illustrated in FIG. 4*a*.

Reference to FIG. 4*a* illustrates the use of a gear drive in lieu of a central lower shaft 33 directed through the porous collection bag 37, wherein the motor gear 39 is rotatably mounted to a lower output end of the motor 29, with a first idler gear 40 secured to an upper end of an idler gear shaft 41, with a second idler gear 42 mounted to a lowermost end thereof. The second idler gear 42 is in operative association with a fan gear 43 that in turn includes a fan gear shaft 44 mounting the fan or impeller 34 at a lowermost end thereof. It should be noted that the gears comprising the motor gear 39 and the first idler 40 are solid to ensure enhanced longevity and strength of the gears, but wherein the lower gear set comprising the second idler gear 42 and the fan gear 43 are apertured (see FIG. 8) to limit obstruction of vacuum directed through the vacuum bag 37.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hair cutting apparatus comprising, a main cylindrical housing, and an upper cylindrical sleeve including an upper annular rim defining an entrance opening, and a motor assembly mounted within the main cylindrical housing including an upper motor shaft extending upwardly, including a cutter assembly mounted onto an upper end of the upper motor shaft, and a lower cylindrical housing securable to a lower end of the main cylindrical housing including a porous collection bag mounted therein, and an impeller assembly mounted within the lower cylindrical housing underlying the collection bag, and a drive means rotating the impeller assembly for creating a vacuum between the impeller assembly and the cutter assembly directing cut hair portions into the collection bag cut by the cutter assembly.

2. An apparatus as set forth in claim 1 wherein the upper cylindrical sleeve is adjustably mountable relative to an upper end of the main cylindrical housing to adjust a spacing between the entrance opening of the upper cylindrical sleeve and the cutter assembly.

3. An apparatus as set forth in claim 2 wherein the motor includes a cylindrical upper guard mounted to an upper end of the motor and a middle guard mounted to a lower end of the motor, wherein the upper and middle guards are apertured and include a central aperture receiving the motor therewithin, and wherein the upper and middle guards define an external diameter substantially equal to an internal diameter defined by the main cylindrical housing to secure the motor within the main cylindrical housing coaxially thereof.

4. An apparatus as set forth in claim 3 wherein the lower cylindrical housing is threadedly securable to the main cylindrical housing, and the porous collection bag is mounted in alignment with an upper end of the lower cylindrical housing and includes an upper support rim mounted to an upper end of the collection bag, and a lower support rim mounted to a lower end of the collection bag, wherein the upper and lower rims support the collection bag between, and wherein the upper and lower rims are secured to the lower cylindrical housing.

5. An apparatus as set forth in claim 4 including a lower guard mounted to a lower end of the lower cylindrical housing, wherein the lower guard defines an apertured cylindrical plate.

6. An apparatus as set forth in claim 5 wherein the drive means defines a lower motor shaft coaxially aligned with the upper motor shaft, wherein the lower motor shaft in operative association with the motor is directed through the upper support rim and the lower support rim through the collection bag, and integrally and orthogonally mounts the impeller assembly between the lower support rim and the lower guard.

7. An apparatus as set forth in claim 5 wherein the drive means include a motor gear operatively associated with a lower end of the motor spaced from the upper motor shaft, and a first idler gear in engagement with the motor gear, the first idler gear mounted to an upper end of an idler shaft, the idler shaft extending from the motor gear below the collection bag, and the idler shaft including a second idler gear mounted to a lower end thereof, the second idler gear in operative engagement with a fan gear, the fan gear including a fan gear shaft directed below the fan gear, wherein the impeller assembly is mounted to a lower terminal end of the fan gear shaft, and the motor gear and the first idler gear are of a solid non-apertured configuration, wherein the fan gear and the second idler gear are apertured to minimize restriction of air flow between the collection bag and the impeller assembly.

* * * * *